US010683630B2

(12) United States Patent
Descamps et al.

(10) Patent No.: US 10,683,630 B2
(45) Date of Patent: Jun. 16, 2020

(54) TIP WITH PROTRUSIONS FOR A GROUND DISPLACEMENT OPERATION FOR A FOUNDATION PILE

(71) Applicant: PROFERRO NV, Ypres (BE)

(72) Inventors: Rik Descamps, Langermark (BE); Christian Cornillie, Voormezele (BE); Nicolas Couckuyt, Geluwe (BE)

(73) Assignee: PROFERRO NV, Ypres (BE)

( * ) Notice: Subject to any disclaimer, the term of this patent is extended or adjusted under 35 U.S.C. 154(b) by 0 days.

(21) Appl. No.: 16/317,614

(22) PCT Filed: Jun. 28, 2017

(86) PCT No.: PCT/IB2017/053862

§ 371 (c)(1),
(2) Date: Jan. 14, 2019

(87) PCT Pub. No.: WO2018/011659

PCT Pub. Date: Jan. 18, 2018

(65) Prior Publication Data

US 2019/0292744 A1 Sep. 26, 2019

(30) Foreign Application Priority Data

Jul. 14, 2016 (BE) ..... 2016/5588

(51) Int. Cl.
*E02D 7/22* (2006.01)
*E02D 5/56* (2006.01)
(Continued)

(52) U.S. Cl.
CPC ..... *E02D 7/22* (2013.01); *B22C 9/10* (2013.01); *B22C 9/22* (2013.01); *E02D 5/22* (2013.01);
(Continued)

(58) Field of Classification Search
CPC .... E02D 5/56; E02D 7/22; E02D 7/72; E02D 5/72
(Continued)

(56) References Cited

U.S. PATENT DOCUMENTS 4,061,197 A * 12/1977 Skidmore, Jr. ..... E21B 4/14 175/101
4,623,025 A 11/1986 Verstraeten
(Continued)

FOREIGN PATENT DOCUMENTS

EP 0087283 A1 8/1983
EP 0855489 A2 7/1998
(Continued)

OTHER PUBLICATIONS

Belgian Search Report from BE Application No. 201605588, dated Dec. 20, 2016.
(Continued)

*Primary Examiner* — Frederick L Lagman
(74) *Attorney, Agent, or Firm* — Workman Nydegger

(57) ABSTRACT

A tip is described which extends axially along a central longitudinal axis and is configured to displace the ground when the tip is being rotated about its central longitudinal axis during a ground displacement operation for a foundation pile. The tip comprises a tip body; several spiral-shaped ribs protruding from the tip body; and several protrusions arranged to the ribs. The protrusions comprise a point which is arranged such that, during rotation of the tip about its central longitudinal axis, the point of the protrusion is ahead of the rib to which the protrusion is arranged. The tip body, the ribs and the protrusions are made as a single-piece casting.

20 Claims, 8 Drawing Sheets

(51) Int. Cl.

| | |
|---|---|
| ***B22C 9/10*** | (2006.01) |
| ***B22C 9/22*** | (2006.01) |
| ***E02D 5/22*** | (2006.01) |
| ***E02D 5/32*** | (2006.01) |

(52) U.S. Cl.
CPC ..... *E02D 5/32* (2013.01); *E02D 5/56* (2013.01); *E02D 2250/0023* (2013.01)

(58) Field of Classification Search
USPC ..... 405/252.1, 253
See application file for complete search history.

(56) References Cited

U.S. PATENT DOCUMENTS

| | | | | |
|---|---|---|---|---|
| 5,143,163 | A * | 9/1992 | Stiffler | E21B 10/44 175/385 |
| 6,082,472 | A | 7/2000 | Verstraeten | |
| 7,357,200 | B2 * | 4/2008 | Harleman | E21B 10/44 175/323 |
| 8,033,757 | B2 * | 10/2011 | Stroyer | E02D 5/56 405/233 |
| 8,845,236 | B1 * | 9/2014 | Dosdourian | E02D 5/801 175/19 |
| 9,157,209 | B2 * | 10/2015 | Biserna | E02D 7/30 |
| 2004/0118615 | A1 * | 6/2004 | Beach | E21B 10/44 175/394 |
| 2006/0198706 | A1 | 9/2006 | Neville | |
| 2006/0260849 | A1 * | 11/2006 | Pedrelli | E02D 5/36 175/386 |
| 2010/0263929 | A1 * | 10/2010 | Ditillo | E02D 5/36 175/19 |

FOREIGN PATENT DOCUMENTS

| | | | |
|---|---|---|---|
| EP | 1412584 | A1 | 4/2004 |
| EP | 1564367 | A1 | 8/2005 |
| WO | 2015130165 | A1 | 9/2015 |

OTHER PUBLICATIONS

International Search Report and Written Opinion from PCT Application No. PCT/IB2017/053862, dated Oct. 4, 2017.
Office Action from corresponding EP Application No. EP17757870, dated Feb. 25, 2020.

* cited by examiner

TIP WITH PROTRUSIONS FOR A GROUND DISPLACEMENT OPERATION FOR A FOUNDATION PILE

BACKGROUND

The invention relates to a tip, more in particular a ground displacement tip for use during a ground displacement operation for a foundation pile. The invention also relates to a method for manufacturing such a tip. Furthermore, the invention also relates to a ground displacement assembly which makes use of such a tip which is attached to the bottom end of a pipe of the ground displacement assembly during a ground displacement operation.

A method for arranging a foundation pile into the ground is known, for example, from EP1412584 and EP1564367. With this method, a hollow steel pipe having a tip at the bottom, more in particular a ground displacement tip, is entered into the ground to the desired depth by a foundation machine. By entering the pipe having the ground displacement tip at the bottom, an opening is formed in the ground for entering or forming a foundation pile. With such a method, for example, the pipe of the foundation machine together with the ground displacement tip is rectracted out of the opening in the ground, wherein the foundation pile can be formed in situ by entering, for example, a steel pipe which is filled with concrete.

It is clear that alternative methods exist wherein use is made of such a tip, more in particular a ground displacement tip, as known, for example, from U.S. Pat. No. 4,623,025 and EP0855489. Such a cast-iron tip is removably attached to the bottom end of a pipe of the foundation machine during a ground displacement operation. The tip is preferably configured as a cast-iron structure, since this facilitates efficient production of a suitable design, in particular when, for example, spiral-shaped ribs are arranged on the surface of the tip body of the tip to achieve an efficient ground displacement operation. In order to couple the tip removably to the bottom end of the pipe of such a ground displacement assembly, the tip is at its top end provided with ridge-shaped structures which couple in corresponding recesses at the bottom end of the pipe. According to this method, the pipe of the ground displacement assembly is entered into the ground layer, together with the tip at its bottom, during a ground displacement operation. After the ground displacement assembly has been entered into the ground layer to the desired depth, concrete is supplied in order to form a concrete foundation pile which is poured in situ. While forming this foundation pile which is poured in situ, the pipe of the ground displacement assembly is removed from the ground layer by the foundation machine, without the tip. The removable tip remains in the ground layer at the bottom side of the concrete foundation pile.

From EP1412584 and EP1564367 embodiments are known of such a ground displacement tip with a tip body to which several spiral-shaped ribs which protrude from the tip body are arranged. In order to improve displacement of the ground during a ground displacement operation and also to improve the mixing with liquid means, such as, for example, concrete slurry, cement, water, etc., which are supplied at the height of the tip during a ground displacement operation, use is made of several protrusions or teeth arranged on the spiral-shaped ribs which extend downwards along the axial drilling direction. However, these teeth or protrusions are subjected to very high loads when the screw movement is being performed during a ground displacement operation. As a result thereof, in particular the protruding teeth are subject to the risk of breaking or damage during the ground displacement operation for a foundation pile, in particular when such a ground displacement tip is applied for a ground displacement operation in relatively hard ground layers.

It is clear that ground drills or ground displacement assemblies are further known which use a tip with a tip body to which, for example, hard-metal or ceramic teeth, bits or cutting platelets are attached. The manufacturing of such hard-metal or ceramic teeth requires complicated and expensive manufacturing techniques, wherein, for example, also the freedom regarding the design of the teeth is limited to, for example, conical teeth. Furthermore, in order to attach such teeth to a tip body, it is required to make use of specific associated attachment elements, for example, which have to be arranged on or in the tip body for attaching such teeth. It is clear that arranging such teeth to the tip body is a complicated and often labour-intensive, manual task, which requires to match the various tolerances related to the tip body, the attachment element, the teeth, etc. accurately to each other in order to guarantee a high-quality attachment. Manufacturing such a tip thus requires complicated, expensive manufacturing methods, as a result of which such a tip is not suitable for use in ground displacement operations for a foundation pile, in particular when, for example, the tip is left behind in the ground layer as part of a foundation pile assembly. Furthermore, the attachment elements for the attachment of such teeth to the tip body lead to a risk of teeth breaking when these are subjected to high loads during a ground displacement operation.

SUMMARY

It is an object of the invention to improve such a tip, so that a more efficient ground displacement is possible, in particular during a ground displacement operation for a foundation pile. Furthermore, it is aimed to form a robust tip which can be manufactured in a simple manner.

This object is achieved, according to a first aspect of the invention, by a tip which extends axially along a central longitudinal axis and is configured to displace the ground when the tip is rotated about its central longitudinal axis during a ground displacement operation for a foundation pile; the tip comprising:

a tip body;

several spiral-shaped ribs protruding from the tip body; and several protrusions arranged on the ribs, characterized in that:

the protrusions comprise a point which is arranged such that, during rotation of the tip about its central longitudinal axis, the point of the protrusion is ahead of the rib to which the protrusion is arranged; and in that the tip body, the ribs and the protrusions are manufactured as a single-piece casting.

According to a second aspect of the invention, a method for manufacturing a tip according to the first aspect of the invention is provided, characterized in that the method comprises the following steps:

providing a casting mould to form the tip body, the ribs and the protrusions of the tip as a single piece; and subsequently casting liquid material into the casting mould, so that the tip body, the ribs and the protrusions of the tip are manufactured as a single-piece casting.

In this way, a more robust tip is realised which makes a more efficient ground displacement operation possible and which can be manufactured in a simple manner, preferably as a cast-iron or cast-steel structure.

According to a preferred embodiment, the liquid material for manufacturing the single-piece casting consists of liquid metal, such as, for example, cast-iron or cast-steel. However, it is clear that variant embodiments with another suitable material are possible.

Furthermore several advantageous, optional and/or variant embodiments of the invention are defined with reference to the following detailed description.

BRIEF DESCRIPTION OF THE DRAWINGS

Exemplary embodiments relating to the invention will be described below in more detail with reference to the following figures:

FIGS. 2 and 3 diagrammatically show the embodiment of a tip of the ground displacement assembly illustrated in FIG. 1 in more detail, wherein FIG. 2 shows a bottom view along arrow II from FIG. 1, and wherein FIG. 3 shows a similar side view as in FIG. 1;

DETAILED DESCRIPTION OF VARIOUS EMBODIMENTS

Figure 1:
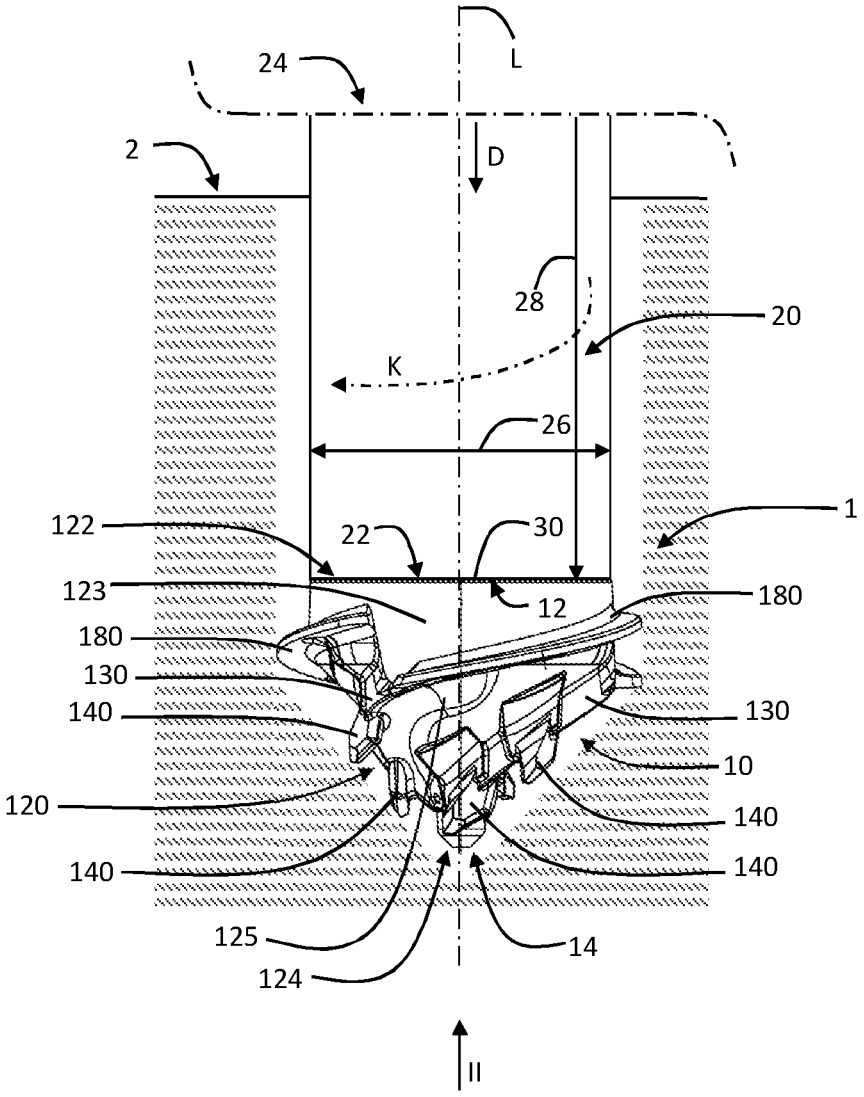
FIG. 1 diagrammatically shows an embodiment of a ground displacement assembly for a foundation pile.

FIG. 1 shows an embodiment of a ground displacement assembly 1 for a foundation pile. As illustrated, the ground displacement assembly 1 comprises a tip 10, which is also referred to, for example, as a ground displacement tip, ground-drill tip, etc., and a pipe 20 arranged thereto and which is also referred to, for example, as a ground displacement pipe, ground-drill pipe, foundation-pile pipe, etc. The pipe 20 of the ground displacement assembly 1 is configured, for example, as an elongate, tubular body, for example, a hollow, cylindrical steel pipe. As illustrated, the pipe 20 extends axially along a central longitudinal axis L, between a bottom end 22 and an opposite top end 24. As further illustrated, the diameter 26 of the pipe 20 is typically smaller than the length 28 of the pipe 20. The diameter 26 of the pipe 20 is typically in the order of magnitude of 10 cm to 50 cm, but may also reach up to, for example, 2 m or 3 m. The wall thickness of the pipe 20 is typically in the range from 1 mm to 10 mm, but may, for example, reach up to 25 mm or more, and is thus typically smaller than 5% of the diameter 26 in order to allow a sufficiently large central opening in the pipe 20 for supplying construction material, such as, for example, concrete, cement, reinforcing iron, etc. The length 28 of the pipe 20 is often in the range from 5 m to 35 m, but may reach up to, for example, 50 m or more. In any case, the length 28 of the pipe 20 is typically a multiple of its diameter 26.

According to the illustrated exemplary embodiment in FIG. 1, the ground displacement assembly 1 further comprises a tip 10 which can function as ground displacement tip. As illustrated, the tip 10 is attached at the bottom end 22 of the pipe 20 of the ground displacement assembly 1. As can be seen, the tip 10 also extends axially, this means along the direction of the central longitudinal axis L of the ground displacement assembly 1, from an attachment side 12 to an opposite tip side 14. As illustrated, the tip 10 is connected to the pipe 20 on the attachment side 12. The opposite tip side 14 is thus pointed away from the pipe 20 and in this way forms the bottom end of the ground displacement assembly 1. The tip 10 and the pipe 20 of the ground displacement assembly 1 may be connected to each other by means of suitable attachment means 30, such as, for example, a welded connection, a bolt connection, a suitable connection with corresponding coupling, corresponding ridges and recesses, etc. Such attachment means are known to a person skilled in the art, such as, for example, from EP1412584, EP1564367, US4623025, EP0855489, etc., and allow to achieve a suitable permanent or removable connection between the tip 10 and the pipe 20 of the ground displacement assembly 1.

During a ground displacement operation, this means during entering the ground displacement assembly 1 into the ground layer 2, the tip 10 is entered first into the ground layer, followed by the pipe 20. In this case, the ground displacement assembly 1 is entered axially, this means substantially along the direction of the central longitudinal axis L, into the ground layer 2, substantially along the direction illustrated by arrow D in FIG. 1. It is clear that in this case, the tip 10 of the ground displacement assembly 1 penetrates the ground layer 2 first at its tip side 14, followed by its attachment side 12 which is connected at the attachment side 12 of the pipe 20, and subsequently the pipe 20. Preferably, the ground displacement assembly 1 is entered into the ground layer 2 by means of a suitable apparatus. Such an apparatus is for example known as a foundation machine, pile-driving machine, etc., such as, for example, the IHC Fundex F3500 model, manufactured by IHC FUNDEX Equipment B.V. Such a foundation machine enters the ground displacement assembly 1 into the ground layer 2, for example by means of a screw movement. In this case, as illustrated in FIG. 1, a torque K, around the central longitudinal axis L, and a pressure force D, along the direction of the central longitudinal axis L, are exerted on the ground displacement assembly 1. In this case, the torque K may reach up to, for example, 500 kNm and the downward pressure force D may in this case reach up to, for example, 50 tons or 500 kN.

For an efficient penetration of the ground layer by means of a screw movement, the tip 10 preferably comprises a tip body 120 with several spiral-shaped ribs 130 which protrude from the tip body 120 and to which protrusions 140 are arranged, as illustrated in FIG. 1 and described in more detail below. It is clear that this downward screw movement of the tip 10 is the result of a rotation about the central longitudinal axis L along the direction of rotation, denoted by arrow K, as a result of the torque about the central longitudinal axis L, also along the direction of rotation denoted by arrow K and which may consequently also be referred to as torque K, and a downward movement due to the pressure force D. It is furthermore clear that this screw movement may have an irregular course during a ground displacement operation. This means that the screw movement of the ground displacement assembly 1 may proceed with the necessary variations with regard to the downward movement and/or the speed of rotation, for example, due to associated variations in the resistance of the ground layer 2 to the pressure force D and the torque K, respectively, which is exerted on the ground displacement assembly 1 during such a ground displacement operation. During a ground displacement operation, the tip side 14 thus forms, as illustrated, a bottom end 124 of the tip body 120 of the tip 10, and the attachment side 12 a top end 122 of the tip body 120 of the tip 10 of the ground displacement assembly 1. The illustrated exemplary embodiment from FIG. 1 comprises a tip body 120 which comprises a conical part 125 with a conical outer surface having a decreasing diameter in the direction of the bottom end 124. As can be seen, the spiral-shaped ribs 130 are arranged to this conical outer surface of the conical part 125. According to this exemplary embodiment, these spiral-shaped ribs 130 protrude substantially axially, along the direction of the central longitudinal axis L, from this conical outer surface of the conical part 125 of the tip body 120. As illustrated, these spiral-shaped ribs 130 are in this case directed downwards during a ground displacement operation. During a ground displacement operation of a foundation machine as described above, the tip 10 thus functions as a ground displacement tip or a ground displacement drill tip. This means that the ground will be pushed aside laterally and/or upward at the height of this tip 10 during a ground displacement operation in order to make space for a foundation pile. During the ground displacement operation, the ground displacement assembly 1 is entered into the ground layer 2 until the tip 10 has reached a suitable depth.

According to an exemplary embodiment, wherein a foundation pile formed in situ is formed, concrete slurry, a cement emulsion or another suitable liquid is already supplied at the height of the tip 10 of the ground displacement assembly 1 during the ground displacement operation. As is known by the person skilled in the art, a concrete shell is thus already formed around the pipe during the downward movement of the ground displacement assembly 1 during the ground displacement operation, in particular when the maximum diameter of the tip 10 is greater than the diameter of the pipe 20. When the tip 10 has reached the suitable depth during the ground displacement operation, the downward movement of the ground displacement assembly 1 is stopped. Subsequently, depending on the exemplary embodiment, the pipe 20, optionally together with the tip 10 of the ground displacement assembly 1, is removed again from the ground layer 2 with an upward movement, thus forming an opening or emptiness in the ground layer for a foundation pile. Depending on the exemplary embodiment, a foundation pile may be formed or entered, for example, during or after the retraction of the pipe 20, by means of entering, for example, a pre-formed steel or concrete foundation pile, a steel housing for a foundation pile, concrete, reinforcing element and/or other suitable materials for forming a foundation pile formed in situ, etc., in the opening or emptiness formed by the ground displacement assembly. It goes without saying that numerous variant embodiments of the foundation pile which may be pre-formed or formed in situ are possible, as long as they are generally suitable to be formed or entered in an opening or emptiness in the ground layer 2 formed by such a ground displacement assembly 1 by means of a ground displacement operation. With the exemplary embodiments described by means of the figures, the ground displacement operation by means of the ground displacement assembly 1, wherein ground of the ground layer 2 is displaced in order to form an opening or an emptiness, may be regarded in particular as being ground pushing aside, this means that in such embodiments a ground pushing aside assembly 1 with such a tip 10 performs a ground pushing aside operation, wherein substantially ground from the ground layer 2 is pushed aside in order to form such an opening or emptiness. However, it is clear that, according to alternative embodiments of such a ground displacement operation performed by alternative embodiments of such a ground pushing aside assembly, for example, in the context of the entering or forming of a foundation pile or the drilling of an opening in the ground, instead of or in addition to such a ground pushing aside operation, for example, a ground removal operation or any other suitable ground treating operation may be performed, wherein ground of the ground layer is displaced, pushed aside, removed, . . . in order to form such an opening or emptiness in the ground. According to an example of such an alternative embodiment, it is possible, for example, to arrange helical-shaped ribs or other suitable ground conveying elements to, for example, the pipe 20 of the ground displacement assembly 1, to its outer surface, which extend at least along a part of the length of the pipe and are configured to displace the ground in the vicinity of the ground displacement assembly 1 so that they are at least partly removed from the ground layer 2 during the ground displacement operation.

Although the exemplary embodiment of the ground displacement assembly 1 illustrated in FIG. 1 comprises a pipe 20 which is diagrammatically illustrated as a single pipe 20, according to alternative exemplary embodiments, the pipe 20 may be formed, for example, as a multiplicity of tubular segments which may in each case be connected to each other at the opposite ends, for example, by means of a welded connection, a permanent or removable coupling, a screw connection, etc. Such embodiments of the pipe 20 of the ground displacement assembly 1 allow a ground displacement operation wherein, upon entering into the ground layer 2, the segments are connected, for example one by one, with their bottom end to the top end of an already entered segment, in order to subsequently enable the tip 10 of the ground displacement assembly 1 to gradually reach the desired depth. It is clear in this case that the tip 10 is arranged to the bottom end 22 of the first or bottom segment of the pipe 20, which then also forms the bottom end 22 of the pipe 20.

It is furthermore clear that, according to the illustrated exemplary embodiment in FIG. 1, the ground displacement assembly 1 extends axially along a substantially vertical direction. This means that the central longitudinal axis L of the ground displacement assembly 1 extends substantially along the vertical direction and also substantially transversely to the ground layer 2. When in the following description expressions such as above, below, . . . or similar expressions are used, then this relates to the illustrated orientation of the ground displacement assembly 1. It goes without saying that alternative embodiments and/or alternative orientations are possible, for example, wherein the ground displacement assembly 1 is entered axially at a certain angle with respect to the vertical direction and/or not transversely with respect to the ground layer 2. With such alternative embodiments, this terminology has to be interpreted in the light of a similar positioning or orientation of the elements of the ground displacement assembly 1 along the axial direction, this means along the direction of the central longitudinal axis L.

Figure 2:
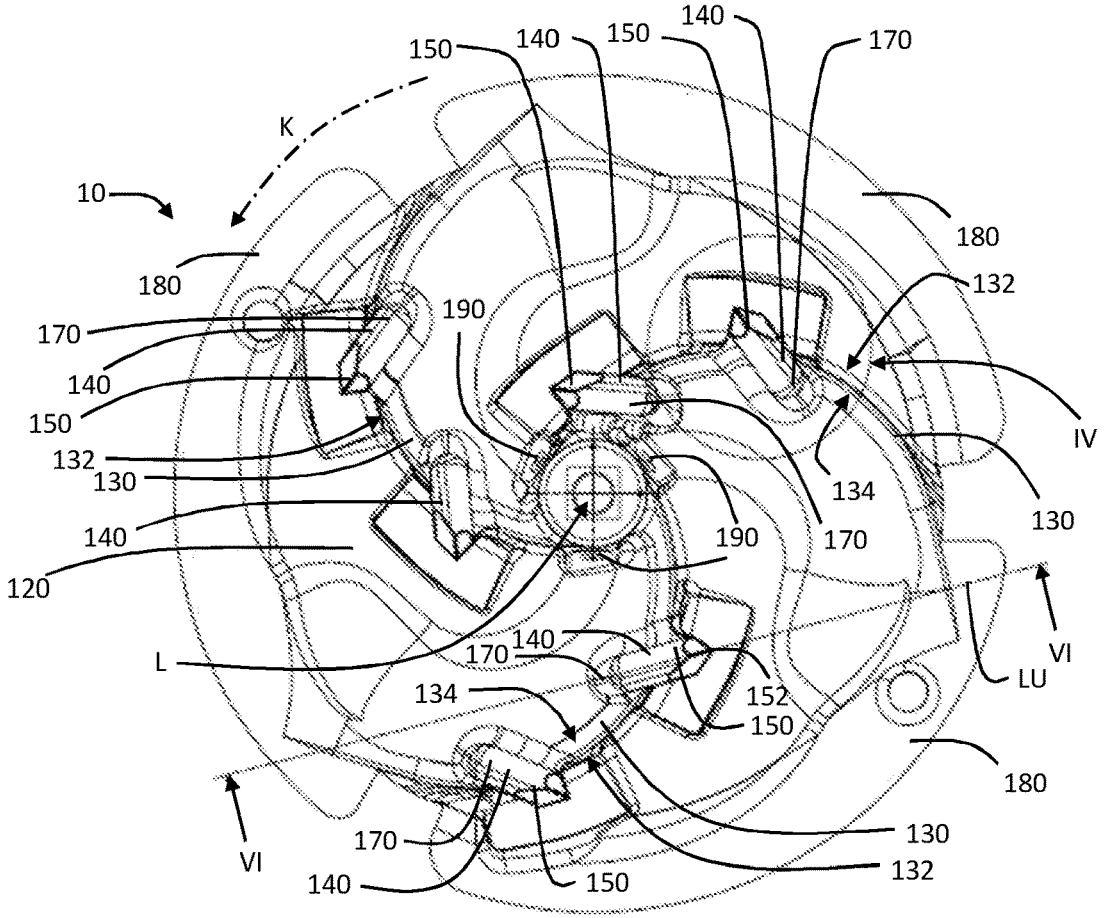
Figure 3:
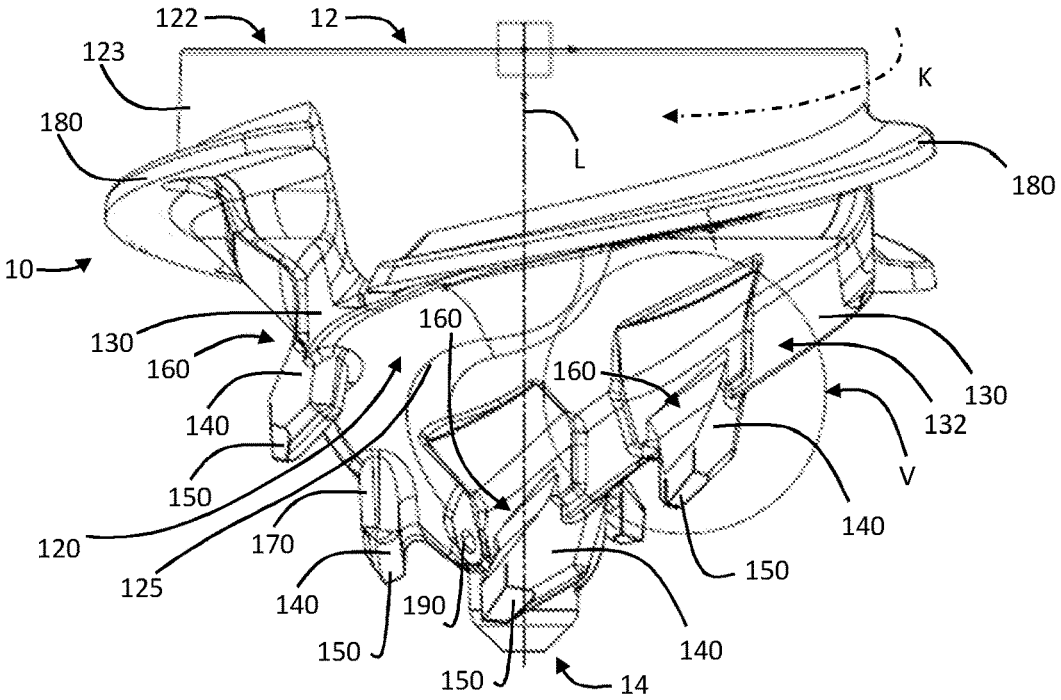

FIGS. 2 and 3 diagrammatically show in more detail the embodiment of the tip 10 of the ground displacement assembly 1 illustrated in FIG. 1. FIG. 2 diagrammatically shows a bottom view of the tip 10 according to arrow II in FIG. 1. This means axially, along the direction of the central longitudinal axis L, from the bottom tip side 14 in the direction of the top attachment side 12 of the tip 10. FIG. 3 shows a similar side view to that of FIG. 1 of the embodiment of the tip 10 illustrated in FIG. 2 on an enlarged scale. As already mentioned above, the tip 10 illustrated in FIGS. 2 and 3 extends axially along a central longitudinal axis L as a function of the displacement of the ground when the tip 10 is rotated about this central longitudinal axis L during a ground displacement operation for a foundation pile. As already described above in relation to FIG. 1, the illustrated tip 10 comprises a tip body 120. As illustrated in FIGS. 2 and 3, several spiral-shaped ribs 130 protrude from this tip body 120. As illustrated most clearly in the view of FIG. 2, this embodiment of the tip 10 comprises three spiral-shaped ribs 130 which are arranged on the tip body 120 so as to be proportionally distributed around the central longitudinal axis L. However, it is clear that alternative embodiments of the tip 10 are possible, wherein the tip 10 comprises, for example, two, four, five or any other suitable number of spiral-shaped ribs 130 which protrude from the tip body 120. It is furthermore also clear that alternative embodiments are possible with regard to, for example, the distribution of the various spiral-shaped ribs 130 on the tip body 120. It is furthermore also clear that, according to variant embodiments, alternative shapes of the spiral-shaped ribs 130 are likewise possible compared to the shape illustrated in FIG. 2. In this case, the spiral-shaped rib 130 generally does not have to correspond perfectly to the shape of a theoretic spiral, as long as, viewed along the central longitudinal axis L, the spiral-shaped rib 130 forms a curve whose distance from the central longitudinal axis L increases from the point of the rib 130 closest to the bottom end 124 towards the point of the rib closest to the top end 122. As can best be seen in FIG. 2, the tip 10 comprises several protrusions 140 arranged to the spiral-shaped ribs 130. According to the illustrated exemplary embodiment, each of the three spiral-shaped ribs 130 respectively comprises two protrusions 140 which are arranged thereto, thus, this means six protrusions 140 for the illustrated tip 10. However, it is clear that according to alternative exemplary embodiments, another suitable number of protrusions 140 may be arranged to the spiral-shaped ribs 130 and/or the number and the distribution of the protrusions 140 may also differ from the illustrated exemplary embodiment per spiral-shaped rib 130.

As will be described in more detail below, the tip body 120, the ribs 130 and the protrusions 140 of the tip 10 are manufactured as a single-piece casting. Such a single-piece cast structure of the tip 10 facilitates an efficient production of a suitable design of the tip 10, in particular of, for example, the spiral-shaped ribs 130 which are arranged to the outer surface of the tip body 120, as well as, for example, the shape of the protrusions 140 themselves. According to an embodiment, the tip 10 may be formed as a single-piece cast-iron or cast-steel casting. In the context of this application, cast-steel is understood to mean a cast alloy of iron comprising a carbon mass percentage of less than 2.1% (m/m), this means a carbon mass fraction of less than 0.021 kg/kg. In the context of this application, cast-iron is a cast-iron alloy comprising a carbon mass percentage of more than 2.2% (m/m), this means a carbon mass fraction of more than 0.022 kg/kg, for example, a mass fraction of 0.030 kg/kg or more, in particular a mass fraction of 0.035 kg/kg or more. Depending on the type of cast-iron, one speaks of a carbon content or a carbon equivalent. For example, for nodular cast-iron, one speaks for example of a carbon content of 0.035 kg/kg. For example, for lamellar cast-iron, one speaks for example of a carbon equivalent between 3.53% and 3.8%.

As can best be seen in FIG. 2, the protrusions 140 comprise a point 150 which is arranged such that during the rotation of the tip 10 about its central longitudinal axis L, the point 150 of the protrusion 140 is ahead of the rib 130 to which the protrusion 140 is arranged. This means that when the tip 10 is rotated along the direction of rotation as denoted by arrow K during a ground displacement operation, the point 150 of a protrusion 140 is ahead of the rib 130 to which this protrusion is attached. So this means that, as illustrated in FIG. 2, viewed along the direction of the axis of rotation or central longitudinal axis L of the tip 10, the point 150 of a protrusion 140, along the direction of the direction of rotation denoted by arrow K, is positioned beyond the location of the rib 130 where this protrusion 140 of this point 150 is attached. It is thus clear that, during a ground displacement operation, wherein the tip 10 of the ground displacement assembly 1 is subjected to a screw movement with a direction of rotation about the central longitudinal axis L, as illustrated by arrow K, the ground which is pushed aside is first treated by the points 150 of the protrusions 140 which loosen the ground and subsequently this loosened ground is pushed aside mainly laterally by the spiral-shaped rib 130 to which the protrusions 140 are attached. Due to the points 150 of the protrusions 140 being ahead of the corresponding spiral-shaped rib 130, the ground displacement function of these spiral-shaped ribs 130 can be performed with greater efficiency and reduced risk of breaking or wear because the ground which has already been loosened by the points 150 of the protrusions 140 can be displaced more efficiently and easily as a result of the operation of the spiral-shaped ribs 130 of the tip 10. This allows to perform with such an easy to manufacture tip 10 a more efficient ground displacement operation in harder ground layers and/or with a reduced torque and/or pressure force.

Figure 5:
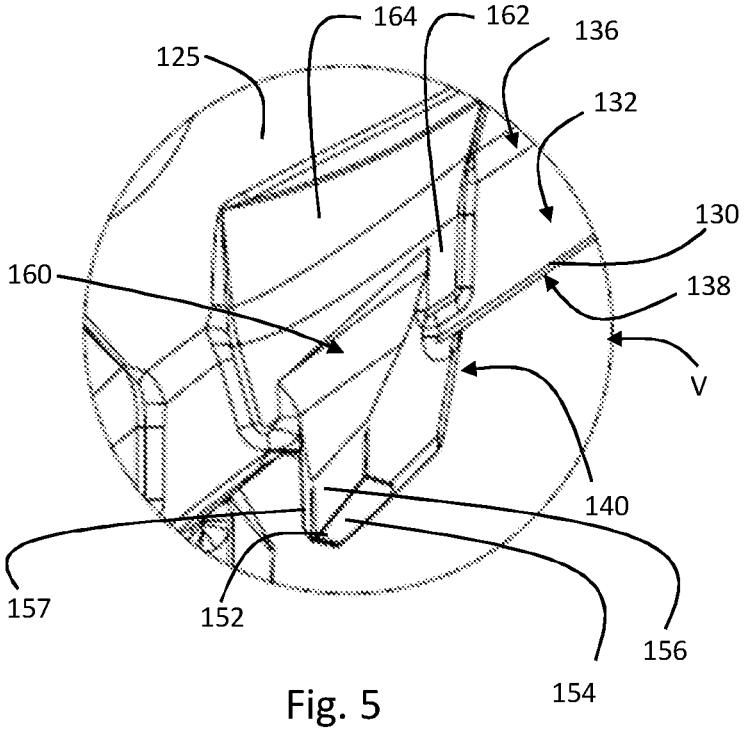
FIG. 5 diagrammatically shows the fragment V from FIG. 3 on a larger scale.

As is best illustrated in FIG. 3, as well as in fragment V of FIG. 3 as illustrated on an enlarged scale in FIG. 5, the protrusions 140 according to the illustrated exemplary embodiment preferably comprise an undercut 160. As illustrated, this undercut 160 of the protrusion 140 extends at least partly between the point 150 of the protrusion 140 and the tip body 120. It is clear that, viewed along the direction of rotation, illustrated by arrow K, the undercut 160 is situated on the same side of the point 150 with respect to the spiral-shaped rib 130 and is thus also ahead of the spiral-shaped rib 130. In other words, the undercut 160 is situated radially substantially at the same height as the protrusion 140. In this case, the undercut is situated on the side of the protrusion 140 which is ahead of the spiral-shaped rib 130, this means the part of the protrusion 140 to which the point 150 is arranged. Axially, this means along the direction of the central longitudinal axis L, the undercut 160 is positioned between the point 150, this means a part of the protrusion 140 which is ahead of the spiral-shaped rib 130, and the tip body 120. As illustrated, in this case the undercut 160 extends axially, at least partly at the height of the spiral-shaped rib 130 according to this exemplary embodiment. As illustrated, such an undercut 160 ensures that, despite the points 150 of the protrusions 140 being ahead of the spiral-shaped rib 130 to which they are attached, the spiral-shaped rib 130 comprises a surface which is as smooth as possible at the height of its front side 132 in order to displace the ground laterally, and wherein the protrusions 140 hamper this lateral movement of the ground during a ground displacement operation as little as possible. It is clear that, as illustrated in FIG. 2, the front side 132 of the spiral-shaped ribs 130 is situated, along the direction of rotation illustrated by arrow K, at the front and extends substantially axially from the tip body 120 in the direction of the tip side 14. It is clear that, during a ground displacement operation, this front side 132 of the spiral-shaped ribs 130 will come into contact with the ground layer 2, mainly due to the rotating movement, and in this case will support mainly the lateral displacement of this ground layer 2, this means in a direction which increases the distance to the central longitudinal axis L. As also illustrated in FIG. 2, the spiral-shaped ribs 130 also comprise a rear side 134 which is situated at the rear of the rib 130, along the direction of rotation illustrated by arrow K, and which also extends substantially axially.

Figure 4:
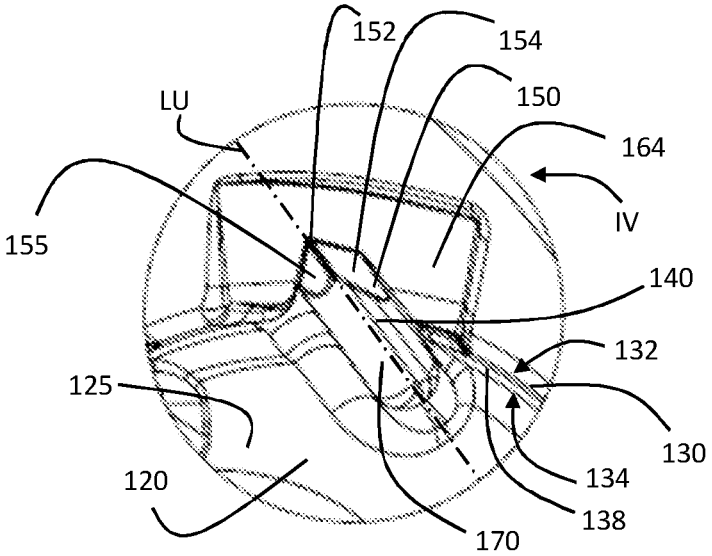
FIG. 4 diagrammatically shows the fragment IV from FIG. 2 on a larger scale.

As can furthermore be seen in FIGS. 2 and 3, as well as in FIG. 4 which shows fragment IV from FIG. 2 on an enlarged scale, the illustrated exemplary embodiment of the protrusions 140 furthermore comprises a base 170. As can best be seen in FIGS. 2 and 4, this base 170 of the protrusions 140 is arranged such that, during rotation of the tip 10 about its central longitudinal axis L, this means along the direction of rotation illustrated by arrow K, the base 170 of the protrusion 140 lags behind the rib 130 to which the protrusion 140 is arranged. In other words, as can be seen, the lagging part of the protrusion 140 which forms the base 170 is situated along the direction of rotation K at the rear of the spiral-shaped rib 130, this means at the rear side 134 of the spiral-shaped rib 130.

According to the illustrated exemplary embodiment in FIGS. 2 to 4, the base 170 of the protrusions 140 is arranged such that the rib 130 protruding from the tip body 120 is connected, at the height of the protrusions 140, to the tip body 120 by this base 170. In this way, as illustrated, the base 170 forms a local reinforcement for both the protrusion 140 and the rib 130 to absorb loads which act on the protrusion 140 and/or the rib 130 during a ground displacement operation. Since, during a ground displacement operation, the rear side 134 of the rib 130 forms a kind of dead zone for the ground layer to be displaced, the hindrance due to the bases 170 of the protrusions 140 when displacing the ground layer is minimal. It is clear that, during a ground displacement operation, the lateral movement of the ground layer 2 using the spiral-shaped ribs 130 is substantially supported by the front side 132 of the spiral-shaped ribs 130, and that the rear side 134 of the spiral-shaped ribs 130 has little or no impact on the ground layer 2 during a ground displacement operation. It is thus clear that the bases 170 of the protrusions 140, which extend axially at the height of these ribs 130 on this rear side 134, form little or no obstruction for the ground layer 2, which is pushed aside substantially laterally, this means in a way which increases the distance to the central longitudinal axis L, during the screw movement of the tip 10 along the direction of rotation K.

As already mentioned above with reference to FIG. 1, the tip body 120 of the illustrated embodiment of the tip 10 comprises a conical part 125 and a cylindrical part 123. As illustrated, during a ground displacement operation, the conical part 125 is at the bottom and the cylindrical part 123 is at the top, this means, viewed along the direction of the central longitudinal axis L, which also forms the central longitudinal axis of the drill tip body 120 in order thus to make rotation possible during the screw movement. The conical part 125 comprises a conical outer surface with a decreasing diameter in the direction of the bottom end 124. Such a shape facilitates entering of the tip into the ground layer 2 and the displacement of this ground layer 2. It is clear that alternative embodiments for the conical part 125 are possible and that the conical part does not have to form a perfect mathematical cone, any suitable shape for the tip body 120 with a substantially decreasing diameter in the direction of the bottom end 124 may be regarded as being conical and supports the entering in and the displacement of the ground layer 2.

According to the illustrated embodiment, the spiral-shaped ribs 130 are arranged to this conical outer surface of the conical part 125. This means that the spiral-shaped ribs 130 protrude from this conical part 125 of the tip body 120 of the tip 10. As illustrated in FIGS. 2 to 5, according to this exemplary embodiment, the spiral-shaped ribs 130 protrude axially, along the central longitudinal axis L, from the conical part 125 of the tip body 120 of the tip 10. In this case, the ribs 130 protrude axially from the tip body 120, from an adjoining end 136 of the rib 130 on the tip body 120 to an opposite external end 138 of the rib 130 which is pointed away from the tip body 120. This therefore means that the spiral-shaped ribs 130, as illustrated, extend axially downwards during a ground displacement operation. This means substantially along the central longitudinal axis L, in the direction of the bottom tip side 14 of the tip 10.

It is clear that alternative embodiments of the tip 10 are possible, wherein the shape of the tip body 120 differs from the illustrated exemplary embodiment having a conical part 125 and a cylindrical part 123. Preferably, the tip 10 extends axially from a top attachment side 12 for the attachment of the pipe 20 to an opposite bottom tip side 14 along the central longitudinal axis L, and the tip 10 comprises a tip body 120 which also extends axially along this central longitudinal axis L of the tip 10, from a top end 122 to a bottom end 124. This makes a ground displacement operation using of the above-described screw movement about this central longitudinal axis L possible. During such a ground displacement operation, the spiral-shaped ribs 130 which, as described above, protrude axially along the central longitudinal axis L of the tip 10 from the tip body 120, support an efficient displacement of the ground layer, substantially along a lateral direction, this means along a direction pointed away from the central longitudinal axis L.

According to the exemplary embodiment illustrated in FIGS. 1 to 5, the tip body 120 of the tip 10, in addition to the conical part 125 with the spiral-shaped ribs 130, also comprises a cylindrical part 123 at the top end 122. As can be seen, this cylindrical part 123 comprises a cylindrical outer surface which adjoins the conical part 125. Furthermore, according to the illustrated exemplary embodiment, one or more helical-shaped ribs 180 are arranged to the cylindrical outer surface of this cylindrical part 123. In contrast to the axial spiral-shaped ribs 130, these helical-shaped ribs 180 protrude radially from the cylindrical part 123 of the tip body 120 with respect to the central longitudinal axis L of the tip 10. This means essentially transversely to the central longitudinal axis L and substantially transversely to the cylindrical outer surface of the cylindrical part 123. Such helical-shaped ribs support the axial movement of the tip 10 during a ground displacement operation, complement the substantially lateral ground displacement of the conical part 125 with a more upward ground displacement along the cylindrical part of the tip 10 and about the cylindrical outer surface of the pipe 20 at the height of its bottom end 22. Furthermore, these helical-shaped ribs 180 can also offer support during the mixing of the ground layer and concrete slurry, cement slurry or any other suitable slurry or liquid which is supplied at the height of the tip 10 during a ground displacement operation, as will be described below in more detail. As already mentioned above, according to the illustrated exemplary embodiment, for example, concrete slurry will be supplied to suitable slurry-supply openings 190 during the downward movement of the ground displacement assembly 1. The illustrated exemplary embodiment comprises three such slurry-supply openings 190 which are arranged on the conical part 125 of the tip body 120. It is clear that alternative embodiments are possible, wherein another suitable number of one or more such slurry-supply openings 190 is provided, and/or wherein such slurry-supply openings 190 are provided at alternative positions in the tip 10. It is preferred in this case, as in the illustrated exemplary embodiment, to arrange these slurry-supply openings 190 on or near the rear side 134 of a respective spiral-shaped rib 130, for example, since a kind of dead zone is formed there during a ground displacement operation, where the pressure in the ground layer is locally the lowest and thus it is easiest to supply slurry. It is furthermore also preferred to supply the slurry, as illustrated, at a position near the central longitudinal axis. This allows to mix and distribute the slurry in an optimum manner about the entire circumference of the tip and the pipe of the ground displacement assembly 1. According to the illustrated exemplary embodiment, the slurry is supplied from the slurry-supply openings 190 to the ground layer which has been loosened by the protrusions 140 and subsequently mixed together with this ground layer and pushed aside mainly laterally by the conical part 125 of the tip body 120 and the axial spiral-shaped ribs 130 arranged thereto in order subsequently, upon reaching the cylindrical part 123 of the tip body 120, to be distributed about the outer surface of this cylindrical part 123 and subsequently the pipe 20 in an optimum manner by means of the radial helical-shaped ribs 180. According to such an exemplary embodiment, a concrete shell, in which the definitive foundation pile can be arranged or formed afterwards, is already formed about the ground displacement assembly 1 during the downward movement of the ground displacement assembly 1 during a ground displacement operation. It is clear that alternative embodiments are possible which deviate from the tip 10 illustrated in FIGS. 1 to 5, such as, for example, known from U.S. Pat. No. 4,623,025, wherein the spiral-shaped ribs 130 of the conical part 125 merge into and adjoin the helical-shaped ribs 180 on the cylindrical part 123 of the drill tip body 120 of the tip 10, etc.

Figure 6:
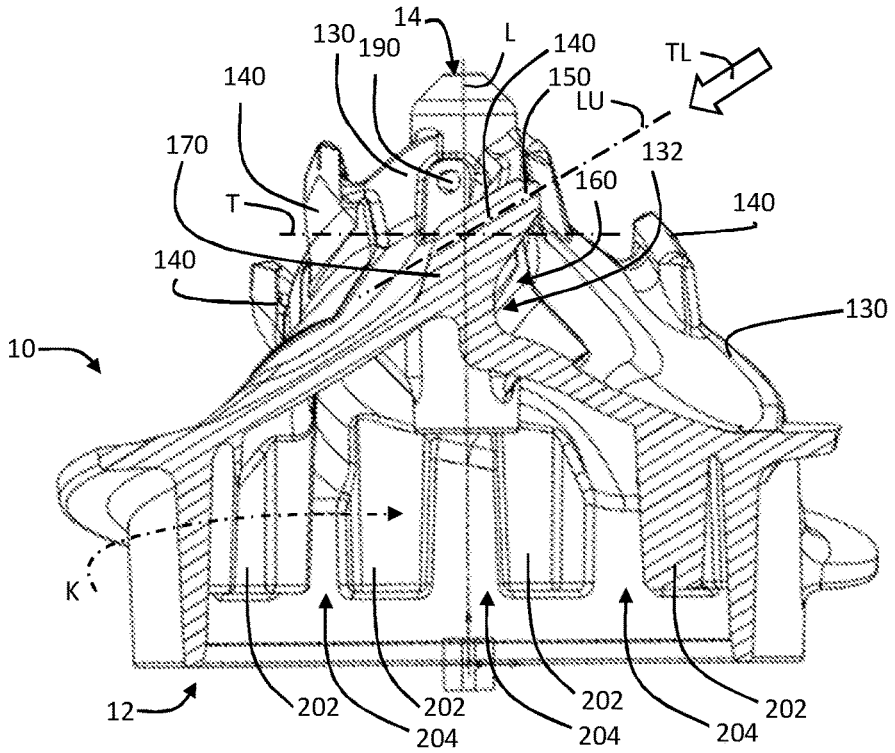
FIG. 6 diagrammatically shows a cross section along line VI-VI from FIG. 2.

FIG. 6 diagrammatically shows a cross section along line VI-VI in FIG. 2. This means a cross section along the central protrusion-longitudinal axis LU of a protrusion 140 of the tip 10, viewed along the central longitudinal axis L of the tip 10. As can be seen, this embodiment of the tip 10, as known by the person skilled in the art, comprises axially extending ridges 202 and recesses 204 at the inner wall of the tip body 120 of the tip 10 at the height of the attachment side 12 of the tip 10. According to this exemplary embodiment, the pipe may comprise corresponding axial ridges and/or recesses at the height of its bottom end 22, which are configured to engage in the ridges 202 and recesses 204 of the tip. As already mentioned above, this allows to attach the tip 10 to the bottom end 22 of the pipe 20 in a detachable manner. With such an embodiment, wherein for example, during the ground displacement operation, only the pipe 20 is removed from the ground layer 2 again and the tip 10 is left behind in the ground layer 2 as a support point for the foundation pile, it is particularly advantageous that the protrusions 140, the spiral-shaped ribs 130 and the tip body 120 are formed as a single-piece cast structure, since thus an efficient, simple, robust and inexpensive tip can be produced by means of an efficient, simple and robust production process. It is furthermore clear that, according to this exemplary embodiment, the transverse cross section of the outer surface of the pipe 20 at least partly adjoins the inner surface of the cross section of the tip 10 at the height of the bottom end 22. However, it is clear that variant embodiments are possible, which deviate from the illustrated exemplary embodiment, wherein, preferably at the height of the bottom end 22, the transverse cross section of the pipe 20 at least partly adjoins or corresponds to the cross section of the tip 10 at the height of the attachment side of the tip 10. It is furthermore clear that yet other variant embodiments are possible, wherein the tip 10 is removably or permanently attached at its attachment side to the bottom end 22 of the pipe 20 in order to form a ground displacement assembly 1 during a ground displacement operation.

As can best be seen in FIGS. 3 and 5, the illustrated exemplary embodiment preferably comprises protrusions 140 of which the point 150 penetrates deeper into the ground layer 2 locally than the spiral-shaped rib 130 to which the respective protrusion 140 is attached during a ground displacement operation. This means that, as illustrated in FIG. 5, the point 150 of the protrusions 140 comprise an outermost end 152 which protrudes further towards the bottom tip side 14 of the tip 10 than the external end 138 of the rib 130 at the height of the respective protrusion 140.

Figure 7:
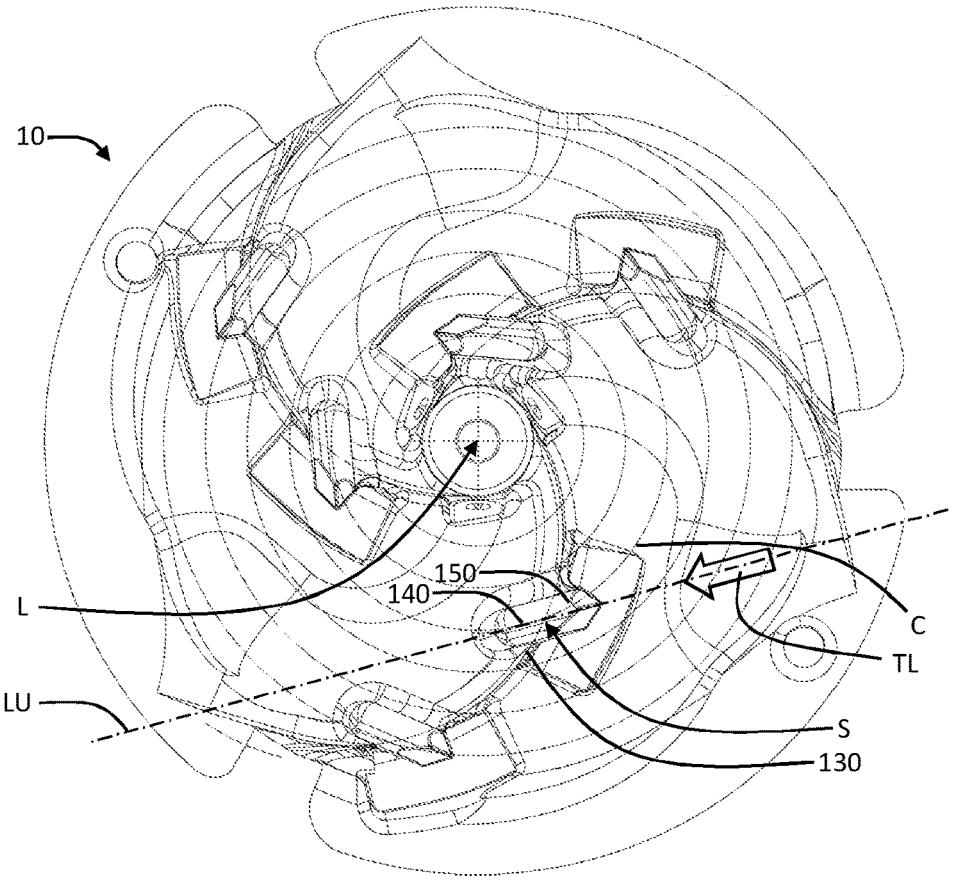
FIG. 7 diagrammatically shows a view similar to that illustrated in FIG. 2, wherein auxiliary lines have been added to clarify the radial position of the protrusions.

As indicated in FIGS. 2 and 4, this means along the direction of the central longitudinal axis L of the tip 10, according to the illustrated exemplary embodiment, the protrusions 140 extend along a central protrusion-longitudinal axis LU. As can be seen, the illustrated exemplary embodiment of the protrusions 140 comprises an elongate shape which extends longitudinally along this protrusion-longitudinal axis LU along this direction of the central longitudinal axis, with a narrowing point shape at the height of the outermost end 152 of the point 150, which will be described in more detail below. FIG. 7 shows a same view to that of FIG. 2, but with the addition of circles C for the respective protrusions 140 of the tip 10. These circles C have as center point the central longitudinal axis L of the tip 10. The circumference of these circles C passes through the intersection S of the protrusion-longitudinal axis LU of the respective protrusion 140 with the rib 130 to which the respective protrusion 140 is attached. In other words, this intersection S is situated at the intersection of the protrusion-longitudinal axis LU of the protrusion 140 and the spiral shape of the spiral-shaped rib 130, as illustrated in FIG. 7. As illustrated, the central protrusion-longitudinal axis LU of the protrusion 140 coincides with the tangent on the circle C in the intersection S. Although this is only indicated in detail by means of one protrusion 140, this is also the case for all protrusions 140 which are present on the respective spiral-shaped ribs 130. This therefore means that, viewed along the direction of the central longitudinal axis L of the tip 10, the protrusion-longitudinal axis LU of the respective protrusions 140 substantially coincides with the tangent, in the intersection S of the protrusion-longitudinal axis LU with the rib 130 of the protrusion 140, on a circle C through this intersection S and with the central longitudinal axis L of the tip 10 as the center point. Such a direction for the protrusion-longitudinal axis LU ensures that the protrusion can act locally on the ground layer with its point 150 in an efficient manner during a rotation along the direction of rotation R in order to loosen the ground. Furthermore, this also allows to absorb the load to which the protrusion 140, and in particular the point 150, is subjected during the ground displacement operation as a result of the rotation along the direction of rotation in an optimum manner, since this component of the load also acts on the protrusion 140, largely along this tangential direction. It is clear that variant embodiments are possible, for example, wherein the protrusion-longitudinal axis LU forms a certain angle with this tangent, however this angle is preferably kept sufficiently small to absorb the load on the points as a result of the rotation during a ground displacement operation in an optimum manner and thus to reduce the risk of deformation and/or breaking of the protrusions 140. For this purpose, it is advantageous, viewed along the direction of the central longitudinal axis L of the tip 10, that the central protrusion-longitudinal axis LU of the protrusion 140 is situated at an angle of less than 20° with respect to this tangent. This means with respect to the tangent on a circle C through the intersection S of the central protrusion-longitudinal axis LU with the rib 130, wherein this circle comprises the central longitudinal axis L of the tip 10 as the center point. Preferably, this angle between this tangent and the protrusion-longitudinal axis LU of the protrusion 140 is smaller than 10°.

Furthermore, it is also advantageous, as best illustrated in FIG. 6, according to the illustrated exemplary embodiment, to arrange the protrusion 140 in such a manner that the central protrusion-longitudinal axis LU of the protrusion 140 is arranged at an angle with respect to a plane T transversely to the longitudinal axis L. Since the point 150 of the protrusion 140 is ahead of the rib 130 and protrudes further in the direction of the tip side 14 than the rib 130, the point 150 of the protrusion 140 is subjected to a load which is substantially tangential along the circle of rotation C, as described above, and at an angle with respect to the plane T transversely to the longitudinal axis, as illustrated, for example, by arrow TL in FIGS. 6 and 7, when applying the screw movement along direction of rotation K. It is clear that a protrusion-longitudinal axis LU which is also aligned as much as possible with the direction TL of such a load along this direction, can offer optimum resistance to this load. The angle, illustrated in the exemplary embodiment, between this protrusion-longitudinal axis LU and the plane T is approximately 30°. However, it is clear that alternative exemplary embodiments are possible, for example, wherein the central protrusion-longitudinal axis LU is at an angle in the range from 10° to 75° with respect to the plane T transversely to the longitudinal axis L. Preferably, this angle is situated in the range from 15° to 60°. The optimum angle may be determined, for example, as a function of the ratio between the pressure force D and the torque K which is applied during the ground displacement operation, as well as a function of the type of ground layer 2 wherein the ground displacement operation takes place.

In addition, it is possible, as is best illustrated in FIGS. 4 and 5, to also preferably optimise the design of the point 150 of the protrusion 140 in order to loosen the ground layer during a ground displacement operation. According to the illustrated exemplary embodiment, use is made of four inclined surfaces 154-157 which are arranged such that they incline the point 150 pyramidally, as it were, up to the pointed end 152 which is formed by the common intersection of these four surfaces 154-157. It is clear that, as illustrated in FIGS. 1 to 7, these surfaces 154-157 are arranged at an angle with respect to the protrusion-longitudinal axis LU, so that they converge in a common intersection, substantially situated near or on this protrusion-longitudinal axis LU in order thus to form a pointed outermost end 152 of the point 150. It goes without saying that the orientation of these surfaces is preferably chosen such that they optimize loosening of the ground layer 2 and support the ground displacement operation. As illustrated, the point 150 is inclined by corresponding surfaces on either side of a surface along the direction of the longitudinal axis L through the protrusion-longitudinal axis LU. As can be seen in FIG. 4, the point 150 is inclined on the side facing the tip side 14 of the tip 10 by corresponding surfaces 154 and 155, on either side and at the same angle with respect to the surface along the longitudinal axis L through the protrusion-longitudinal axis LU, respectively. The same applies to both corresponding surfaces 156 and 157, best seen in FIG. 5. Such an orientation of these surfaces 154-157 supports efficient loosening of the ground layer and an optimum distribution of the load on the point 150. It is clear that numerous variants are possible regarding the embodiment of the point 150, which differ from the illustrated exemplary embodiment, however, it is clear that the fact that the protrusions 140 form part of the single-piece casting facilitates the optimisation of the design of the point 150 as a function of, for example, a certain type of ground layer. Then, it is namely sufficient to provide a suitable casting mould to realise even protrusions 140 of a complicated design and, in addition, such a manufacturing method allows that the protrusion 140 is always arranged on the drill tip body 120 of the tip 10 in the desired orientation, irrespective of the complexity of the design of the protrusion 140, as a result of which the efficiency of the ground displacement operation is ensured, and further manual actions, tolerances due to an attachment of separate parts, compromises with regard to design due to limited finishing possibilities, etc. are avoided.

As is most clearly illustrated in FIG. 7, for the respective protrusions 140, by means of the auxiliary lines, the circles C through the intersection S and with the central longitudinal axis L as center point are shown. As described above in more detail, this means the circles C through the intersection of the protrusion-longitudinal axis LU and the rib 130 to which the respective protrusion 140 is attached. This almost corresponds to the circular movement which the protrusion 140 travels about the central longitudinal axis L due to the screw movement along the direction of rotation K. As can be seen in FIG. 7, by applying the protrusions 140 at a different distance to the central longitudinal axis L the operation of the different protrusions 140 being distributed as well as possible across the entire surface along the direction of the longitudinal axis L which is covered by the tip 10 during a ground displacement operation. Furthermore, it is also clear that, according to this exemplary embodiment, the protrusions 140 which are arranged to the same rib 130 are arranged at a largest possible distance from each other. Such a positioning of the protrusions ensures that an optimum ground displacement operation is supported, since the protrusions cover an as large as possible surface of the ground layer to be displaced in order to loosen the latter in preparation of the displacement by the spiral-shaped ribs 130, and also since the loosened ground layer 2 encounters as little as possible resistance from the protrusions 140 themselves, since the mutual distance between the protrusions 140 is as large as possible. It is furthermore clear that alternative embodiments are possible, in particular with regard to the number of protrusions 140 and their positioning on the tip 10, however, it is advantageous in this case to arrange as many as possible different protrusions 140 at a different distance to the longitudinal axis L and to maximize the mutual distance between different protrusions 140.

According to the illustrated exemplary embodiment, the protrusions 140 which are arranged on the ribs 130 at a different distance to the central longitudinal axis L preferably have a different undercut 160. This means that, viewed along a plane through the central protrusion-longitudinal axis LU along the direction of the central longitudinal axis L, the undercut 160 of the protrusions 140 differs at a different radial distance. Preferably, this undercut 160 is dimensioned such that it disturbs the spiral-shaped line of the front side 132 of the spiral-shaped rib 130 and the design of the outer surface of the tip body 120 as little as possible. However, as can be seen, the undercut 160 preferably still leaves a certain local thickening 162, 164, respectively at the front side 132 of the spiral-shaped rib 130 and on top of the outer surface of the tip body 120. Such thickenings 162, 164 ensure a more robust attachment of the protrusions 140 and an improved transfer of the load to the points from the protrusions 140 to the tip body 120, with a reduced risk of local deformation of the spiral-shaped ribs 130 and/or the tip body 120. It is clear that variant embodiments of the illustrated thickenings 162, 164 are possible, as long as the thickenings are generally arranged at the height of the protrusion 140 on the spiral-shaped rib 130 and/or on the tip body 120 and preferably only mean a limited local thickening which is such that the ground displacing operation of the tip body 120 and/or the spiral-shaped ribs 130 during a ground displacement operation is disrupted as little as possible.

Figure 12:
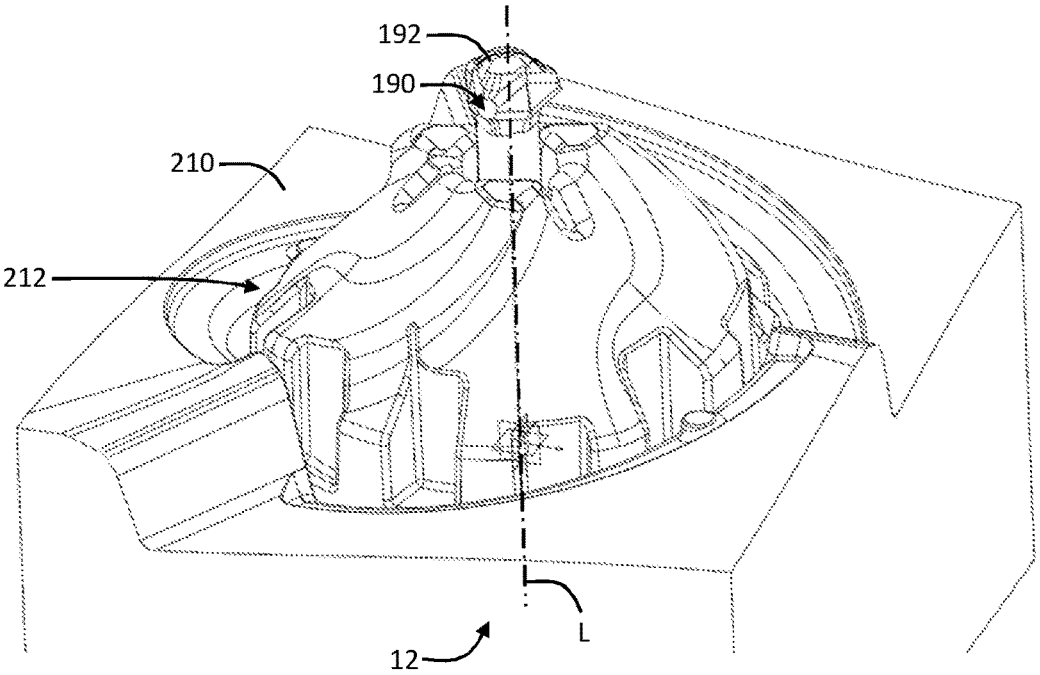
Figure 13:
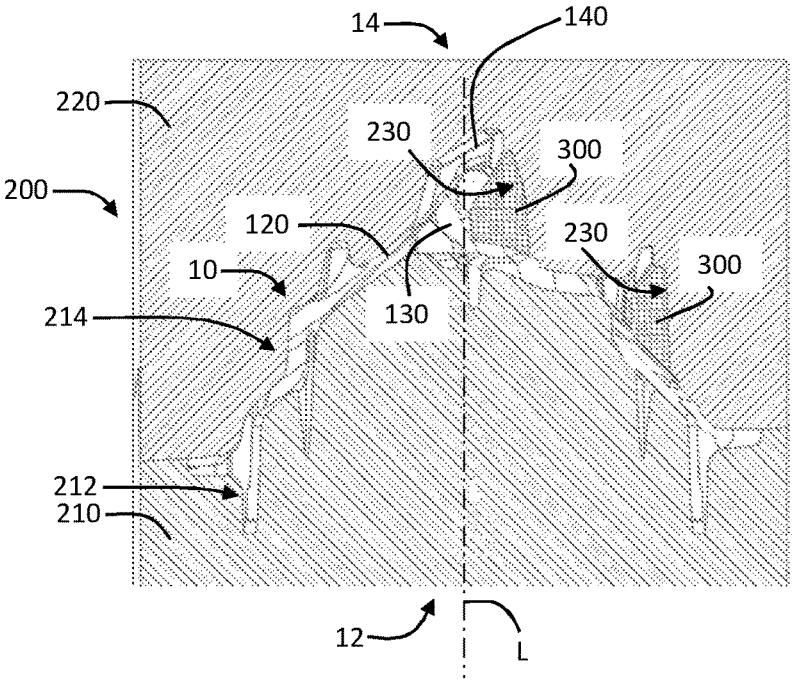
Figure 14:
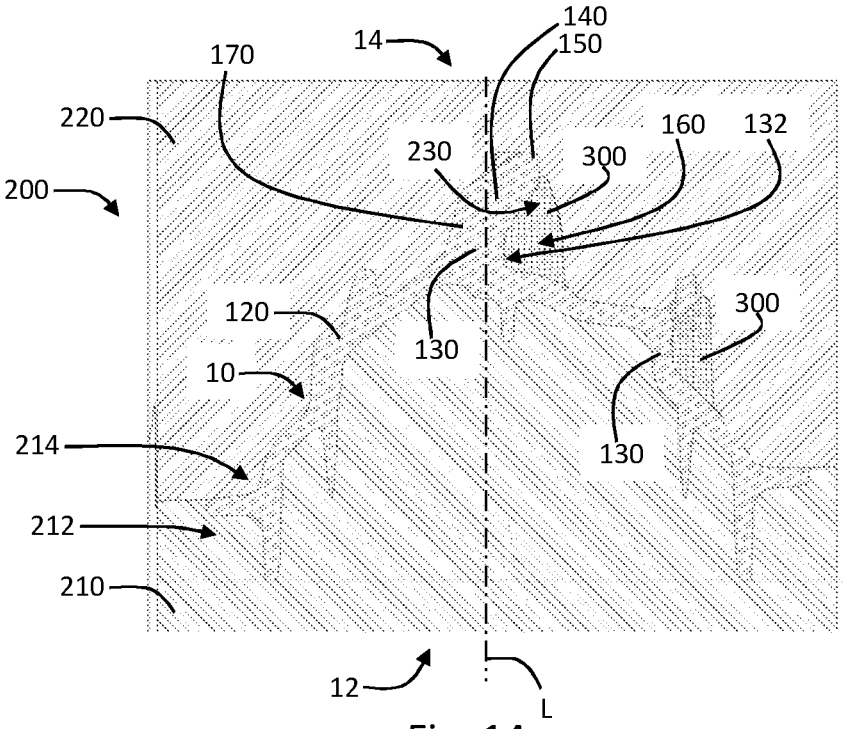

FIGS. 8 to 14 show different views and steps of an embodiment of a method for manufacturing a tip 10 similar to that described above with regard to FIGS. 1 to 7. Similar parts of the tip 10 are denoted by similar reference numerals and will only be described again in so far as is relevant for the method for manufacturing the tip 10. FIG. 14 illustrates the final result of this embodiment of a method for manufacturing the tip 10. In this case, in FIG. 14 is illustrated a cross section through the tip 10 and the corresponding casting mould 200, similar to the cross section illustrated in FIG. 6. As can be seen, a casting mould 200 is provided for forming the tip body 120, the ribs 130 and the protrusions 140 of the tip 10 as a single piece. As illustrated, the method for manufacturing the tip 10 is completed by casting liquid metal in the casting mould 200, so that the tip body 120, the ribs 130 and the protrusions 140 of the tip 10 are manufactured as a single-piece casting. This liquid material is preferably a liquid metal and preferably cast-iron, but may, for example, also be cast-steel or another suitable liquid metal or another suitable liquid material. In this case, it is clear that the liquid material is cast into the casting mould 200 in liquid form. Subsequently, after the liquid metal has at least partly cooled down and solidified, the tip 10 is removed from the casting mould 200, for example, a sand mould. In this case, it is advantageous, as illustrated in FIG. 14, that the casting mould 200 is oriented such that, after removal of the casting mould 200, the tip 10 arrives on its attachment side 12. This allows to remove the tip 10 more quickly, this means after a shorter cooling-down period, from the casting mould, without the risk of damage, for example, to the protrusions 140, the spiral-shaped ribs 130, etc. or other parts which protrude from the tip body 120 in the direction of the tip side 14, since the tip 10 thus arrives on its more robust, cylindrical attachment side 12. According to the exemplary embodiment illustrated in FIG. 14, the casting mould 200 for the tip 10 comprises a bottom sand mould 210 and an upper sand mould 220. It is clear that, although this method for manufacturing a tip 10 makes use of a bottom sand mould 210 and an upper sand mould 220, alternative embodiments of the casting mould 200 are possible, such as, for example, alternative embodiments of sand casting, casting processes using permanent casting moulds, etc.

Furthermore, as illustrated in FIG. 14, and as will be explained in more detail below, removable cores 300 have been arranged in the upper sand mould 220 of the casting mould 200. In a preceding step of the method, with the removable cores 300 corresponding recesses 230 are provided in the casting mould 200. According to the illustrated embodiment, these recesses 230 were thus provided in the upper sand mould 220. As can be seen in FIG. 14, these recesses 230 for the removable cores 300 serve to manufacture the undercuts 160 of the protrusions 140, as already described above in more detail. Subsequently, in a next step of the manufacturing process, the removable cores 300 are inserted into these corresponding recesses 230 in the casting mould 200. These removable cores 300 are pre-formed from a suitable type of sand or another suitable material which remains present in the casting mould 200 during the casting of liquid metal, but is preferably removed together with the removal of the casting mould 200. So, this means that generally, after the step of casting liquid metal into the casting mould 200, the casting mould 200 and the removable cores 300 are removed, so that the cast tip 10 emerges. Thus, for the illustrated exemplary embodiment in FIG. 14, this means that, after the liquid metal has been cast, the upper sand mould 220 and the bottom sand mould 210 of the casting mould 200 are removed together with the removable cores 300.

FIG. 13 shows the step of the method preceding the step illustrated in FIG. 14, this means before casting liquid metal into the casting mould 200. In FIG. 13, the casting mould 200 has already been completed by placing the upper sand mould 220 onto the bottom sand mould 210. According to the illustrated exemplary embodiment, the bottom sand mould 210 for the casting mould 200 comprises an attachment part 212 of the casting mould 200 for a part of the tip 10 on the attachment side 12. The upper sand mould 220, which, together with the bottom sand mould 210, completes the casting mould 200, comprises a tip-part 214 of the casting mould 200 for a part of the tip 10 near the tip side 14. According to the illustrated exemplary embodiment, this tip-part 214 comprises the part of the casting mould 200 for the spiral-shaped ribs 130 and the protrusions 140.

FIG. 12 shows the embodiment of the bottom sand mould 210 from FIGS. 13 and 14 in more detail before the casting mould 200 was completed with the upper sand mould 220. As can be seen, a temporary, removable core 192 was arranged in this bottom sand mould to manufacture the internal conduits to the slurry-supply openings 190 in the tip 10 during the casting process. This removable core 192 is pre-formed from a suitable type of sand or another suitable material which remains present in the casting mould 200 during the casting of liquid metal, but is removed, preferably together with the casting mould 200. So this means that the casting mould 200 and the removable core 192 for the slurry-supply openings 190 are generally removed after the step of casting liquid metal into the casting mould 200, so that the cast tip 10 provided with suitable internal conduits to the slurry-supply openings 190 emerges. It is clear that, according to alternative embodiments of the tip 10 and/or the method for manufacturing the tip 10, alternative or permanent cores may be provided in the bottom sand mould. It is furthermore clear that according to still further alternative embodiments, a bottom sand mould 210 without removable or permanent cores may be applied, in particular, for example, when a tip 10 without supply openings is being manufactured. It is clear that the orientation of the bottom sand mould 210 in FIG. 12 corresponds to the orientation illustrated in FIGS. 13 and 14 of the completed casting mould 200, this means with the attachment side 12 of the part of the tip 10 at the bottom.

Figure 11:
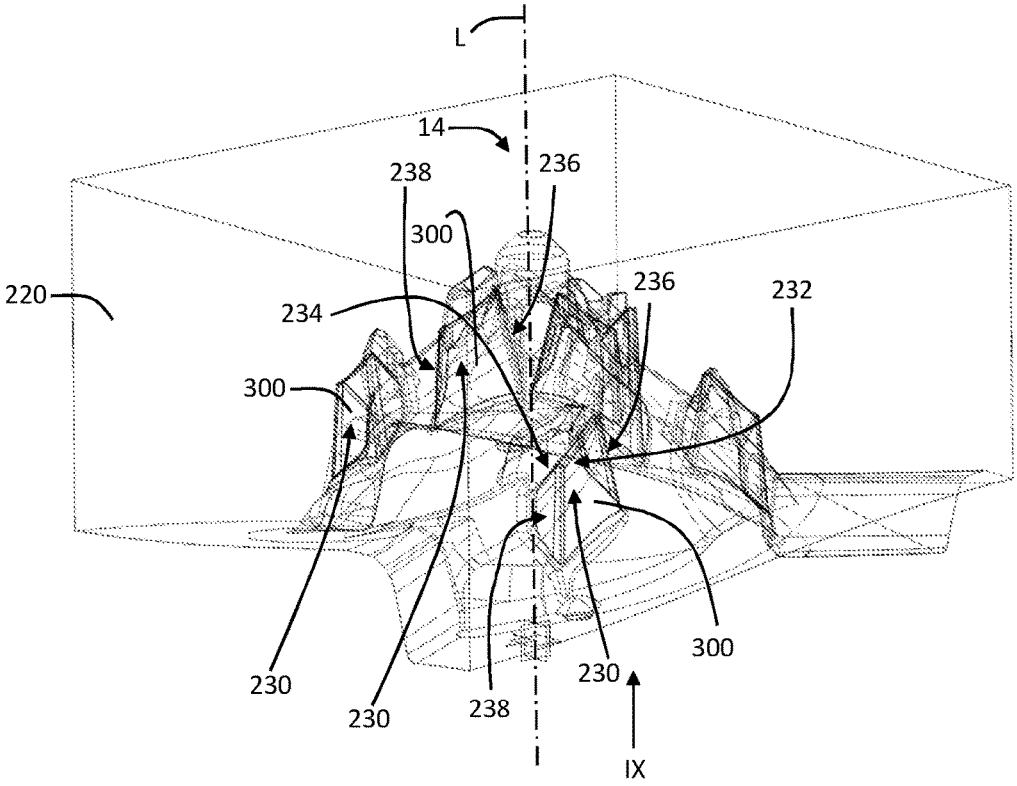

FIG. 11 shows the embodiment of the upper sand mould 220 from FIGS. 13 and 14 in more detail before the casting mould 200 was completed with the bottom sand mould 210. As can be seen, the removable cores 300 have already been inserted into the upper sand mould 220 before the casting mould 200 was completed. The orientation illustrated in FIG. 11 also corresponds to the orientation of the upper sand mould, as illustrated in FIGS. 13 and 14 for a completed casting mould 200, this means with the tip side 14 of the part of the tip 10 at the top. However, it is preferable to insert the cores 300 into the corresponding recesses 230 in the upper sand mould 220 when the upper sand mould 220 is still situated in an inverted orientation, as illustrated in the partial cross section of FIG. 10. That means, during a previous step of the method, when the tip side 14 of the part of the tip 10 is situated at the bottom. Subsequently, the upper sand mould 220 may be turned over in order to reach the state illustrated in FIG. 11, after which the casting mould 200 can be completed by arranging the upper sand mould 220 on top of the bottom sand mould 210, as illustrated in FIG. 13, and subsequently liquid metal may be cast into the casting mould 200, as illustrated in FIG. 14. It is clear that, since, for example after completion of the casting mould 200 as illustrated in FIG. 13, the completed casting mould 200 has to be transported over a certain distance towards a casting zone for casting liquid metal into the casting mould 200, that the removable cores 300 and the corresponding recesses 230 in the casting mould are preferably dimensioned such that they have a kind of self-clamping operation, so that the removable cores 300 are held in place in the upper sand mould 220, even in the state illustrated in FIGS. 11 and 13. Although it is possible to insert these removable cores 300 into the recesses 230 in the upper sand mould 220 in the position illustrated in FIG. 10 by machine, the addition of such removable cores is often performed by hand. It is therefore important that this process can be performed as efficiently and consistently as possible. As is most clearly illustrated in FIG. 10, the cores 300 and the corresponding recesses 230 in the casting mould 200 comprise a first pair of cooperating tapering surfaces 232, 234 which taper towards each other in the direction of the tip side 14. As is illustrated, they also comprise a second pair of such tapering surfaces 236, 238. It is clear that alternative embodiments are possible, provided that they comprise at least a pair of cooperating tapering surfaces which taper towards each other in the direction of the tip side 14. These cooperating tapering surfaces ensure a self-clamping operation, thus ensuring that the removable cores 300 are held in the recess 230 even when they are in the inverted orientation. Furthermore, these tapering surfaces also ensure a correct positioning of the removable cores 300 in the recesses 230. Even when they are inserted manually, the tapering surfaces ensure that the removable core 300 is guided up to a clearly defined end position in the corresponding recess 230.

Figure 9:
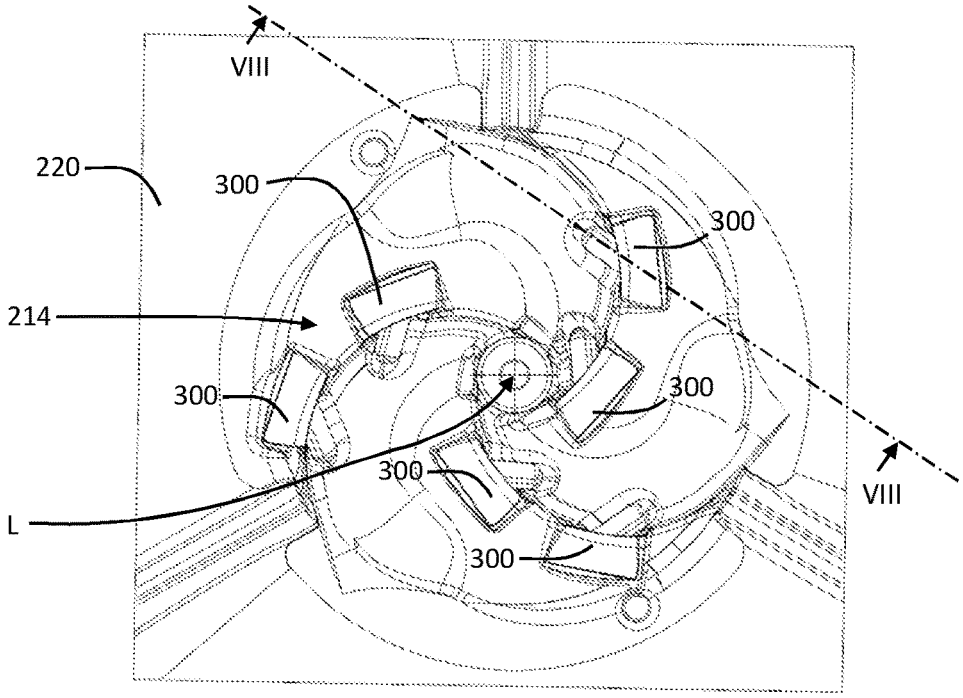
Figure 10:
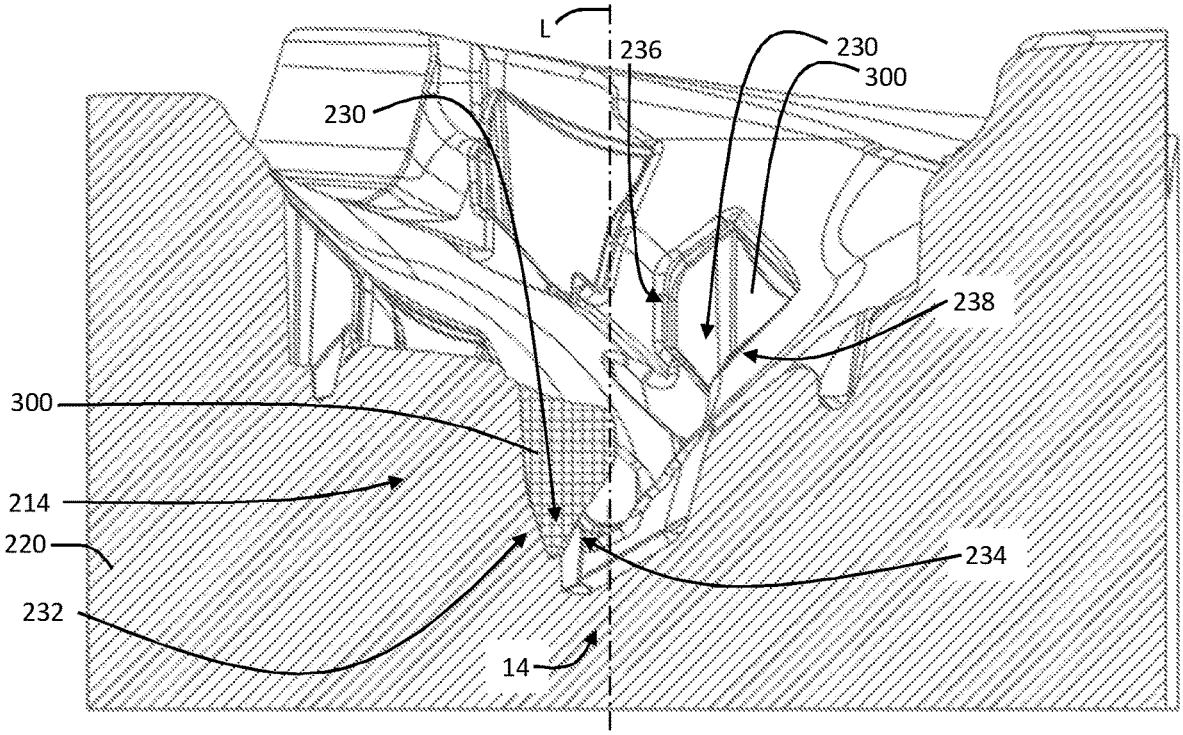

Furthermore, as is the case with the illustrated embodiment and can best be seen in FIG. 9, which shows a view along the arrow IX in FIG. 11 of the upper sand mould 220 wherein the removable cores 300 have already been arranged, it is preferable that the removable cores 300 are dimensioned and positioned in the casting mould 200 in such a manner that identical cores 300 can be applied for the manufacturing of undercuts 160 of different protrusions 140. It is particularly advantageous when the removable cores 300 have to be inserted manually into the corresponding recesses 230 in the upper sand mould 220, since an operator can always insert the same removable core 300 in an efficient manner, irrespective of the specific recess 230 into which he has to insert this removable core.

Figure 8:
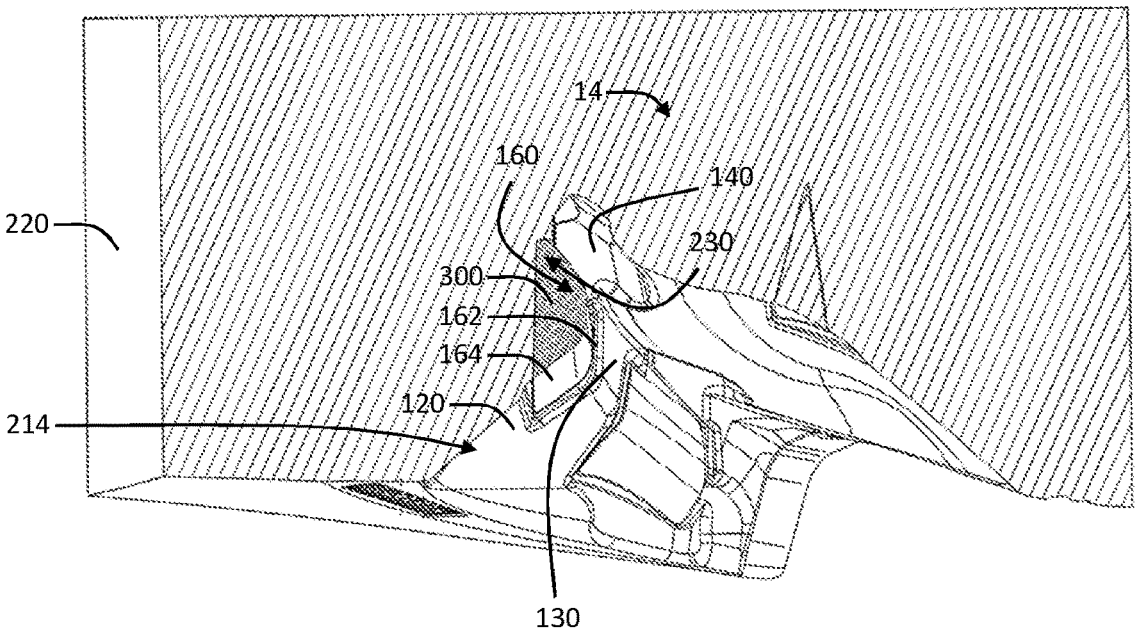
FIGS. 8 to 14 show different views and steps of an embodiment of a method for manufacturing a tip similar to that illustrated in FIGS. 1 to 7.

Finally, it is advantageous, as illustrated in the exemplary embodiment, that the cores 300 are dimensioned such that a thickening 162, 164 is provided on the rib 130 and/or the tip body 120 at the height of the undercuts 160 of the protrusions 140. This can best be seen in the cross section along line VIII-VIII from FIG. 9, as illustrated in FIG. 8. Such an embodiment namely allows to compensate for tolerances with regard to the dimensioning of the removable cores 300 and the corresponding recesses 230 in the casting mould 200 and/or their relative positioning without the risk of causing a local weakening due to an undesired reduction of the cast metal at the height of the attachment of the protrusion 140 to the spiral-shaped rib 130. As already mentioned above, the casting process allows to manufacture a point 150 of a suitable design, irrespective of the complexity, in an efficient manner. As described in more detail above and according to the illustrated exemplary embodiment, use is preferably made of a casting mould 200 which is dimensioned such that the point 150 of the protrusions 140 comprises an outermost end 152 which is formed by one or more inclined surfaces 154-157. This allows to fabricate a strong point 150 with such a casting process, since such a design allows sufficient liquid metal to reach the outermost end 152 of the point 150 of the protrusion in an efficient manner. In any case, it is not advisable to dimension the casting mould 200 such that the point 150 of the protrusions 140 comprises an outermost end 152 which is conical. It has been found that such a conical outermost end 152 often prevents the desired amount of molten metal to reach the outermost end 152 during the casting process, resulting in a weakened or incomplete point 150 of the protrusion 140. It is therefore advisable to use a casting mould 200 with a non-conical outermost end 152 for the protrusions 140.

Although reference is made to a ground displacement operation, ground displacement assembly, displacing of the ground, etc., in the above-mentioned description, it is clear that, in the context of this description, the term ground displacement may be interpreted as ground pushing aside and/or ground removing, as well as any other suitable ground treating operation wherein ground is displaced, pushed aside, removed and/or discharged, etc.; in particular in the context of entering or manufacturing foundation piles, a ground drilling operation, etc. It is clear that, as described above, the ground displacement function manifests in particular as a ground pushing aside function at the height of the tip during a ground displacement operation. As a result thereof, in particular according to the above-described exemplary embodiments, it is possible to refer to the ground displacement assembly, the ground displacement operation, the displacing of the ground, . . . , with regard to the tip, as a ground pushing aside tip, a ground pushing aside assembly, pushing aside of the ground, a ground pushing aside operation, etc.

It is clear that numerous variant embodiments are possible without departing from the scope of protection of the invention as defined in the claims.

The invention claimed is:

1. A tip which extends axially along a central longitudinal axis and is configured to displace the ground when the tip is rotated about its central longitudinal axis during a ground displacement operation for a foundation pile; the tip comprising:

a tip body;

several spiral-shaped ribs protruding from the tip body; and several protrusions arranged on the spiral-shaped ribs, wherein:

the protrusions comprise a point which is arranged such that, during rotation of the tip about its central longitudinal axis, the point of the protrusion is ahead of the spiral-shaped rib to which the protrusion is arranged; and in that the tip body, the spiral-shaped ribs and the protrusions are a single-piece cast structure.

2. The tip according to claim 1, wherein the protrusions furthermore comprise an undercut which at least partly extends between the point of the protrusion and the tip body.

3. The tip according to claim 1, wherein the protrusions furthermore comprise a base which is arranged such that, during the rotation of the tip about its central longitudinal axis, the base of the protrusion lags behind the spiral-shaped rib to which the protrusion is arranged.

4. The tip according to claim 3, wherein the base of the protrusions is arranged such that the spiral-shaped rib protruding from the tip body is connected, at a height of the protrusions, to the tip body by their base.

5. The tip according to claim 1, wherein:

the tip extends axially from a top attachment side for the attachment of a pipe to an opposite bottom tip side along the central longitudinal axis;

the tip body also extends axially along the central longitudinal axis of the tip, from a top end to a bottom end; and the spiral-shaped ribs protrude axially along the central longitudinal axis of the tip from the tip body, from an adjoining end which adjoins the tip body to an opposite external end pointing away from the tip body.

6. The tip according to claim 5, wherein the point of the protrusions comprises an outermost end which protrudes further towards the opposite bottom tip side of the tip than the external end of the spiral-shaped rib at the height of the respective protrusion.

7. The tip according to claim 6, wherein the tip body comprises a conical part with a conical outer surface having a decreasing diameter in the direction of the bottom end, and in that the spiral-shaped ribs are arranged to this conical outer surface.

8. The tip according to claim 7, wherein the tip body further comprises a cylindrical part at the top end, with a cylindrical outer surface which adjoins the conical part, and in that one or more helical-shaped ribs are arranged to the cylindrical outer surface that protrude radially with respect to the central longitudinal axis of the tip from the cylindrical part of the tip body.

9. The tip according to claim 1, wherein the protrusions extend along a central protrusion-longitudinal axis which is oriented such that:

viewed along the direction of the central longitudinal axis of the tip, the central protrusion-longitudinal axis is situated at an angle of less than 20°, preferably less than 10°, with respect to the tangent:

in an intersection of the central protrusion-longitudinal axis with the spiral-shaped rib, on a circle through the intersection and with the central longitudinal axis of the tip as the center point;

the central protrusion-longitudinal axis is situated at an angle in the range from 10° to 75°, preferably 15° to 60°, with respect to a plane transversely to the central longitudinal axis of the tip.

10. The tip according to claim 9, wherein the protrusions are arranged on the spiral-shaped ribs at a different distance from the central longitudinal axis;

wherein the protrusions which are arranged on the spiral-shaped ribs at a different distance from the central longitudinal axis comprise a different undercut, viewed along a plane through the central protrusion-longitudinal axis along the direction of the central longitudinal axis.

11. The tip according to claim 1, wherein the protrusions are arranged on the spiral-shaped ribs at a different distance from the central longitudinal axis.

12. A ground displacement assembly comprising a tip according to claim 1, wherein the ground displacement assembly further comprises a pipe, and wherein the tip is attached to a bottom end of the pipe.

13. The ground displacement assembly according to claim 12, wherein, at the height of the bottom end, the transverse cross section of the pipe at least partly adjoins or corresponds to the cross section of the tip.

14. The ground displacement assembly according to claim 12, wherein, at the height of the attachment side of the tip and the bottom end of the pipe, the ground displacement assembly comprises corresponding ridges and/or recesses engaging with each other which are configured to connect the tip to the bottom end of the pipe in a detachable manner.

15. A method for manufacturing a tip according to claim 1, wherein the method comprises the following steps:

providing a casting mould to form the tip body, the spiral-shaped ribs and the protrusions of the tip as a single piece; and subsequently casting liquid material into the casting mould, so that the tip body, the spiral-shaped ribs and the protrusions of the tip are manufactured as a single-piece casting.

16. The method according to claim 15, wherein the method further comprises the following steps:

providing recesses in the casting mould for removable cores for manufacturing the undercuts of the protrusions;

subsequently inserting the cores into the corresponding recesses in the casting mould;

subsequently casting liquid material into the casting mould;

subsequently removing the casting mould and the removable cores.

17. The method according to claim 16, wherein the cores are dimensioned and positioned in the casting mould so that identical cores may be applied for manufacturing undercuts of different protrusions.

18. The method according to claim 17, wherein the cores are dimensioned such that a thickening is arranged on the rib and/or the tip body at the height of the undercuts of the protrusions.

19. The method according to claim 16, wherein the cores and the corresponding recesses in the casting mould are dimensioned such that they have a self-clamping operation.

20. The method according to claim 19, wherein the cores and the corresponding recesses in the casting mould comprise at least a pair of cooperating tapering surfaces which taper towards each other in the direction of the tip side.

* * * * *